US005773392A

United States Patent [19]

Romanelli et al.

[11] Patent Number: 5,773,392

[45] Date of Patent: Jun. 30, 1998

[54] OIL SOLUBLE COMPLEXES OF PHOSPHORUS-CONTAINING ACIDS USEFUL AS LUBRICATING OIL ADDITIVES

[75] Inventors: Michael Gerald Romanelli, Brooklyn, N.Y.; Ricardo Alfredo Bloch, Scotch Plains, N.J.; Jack Ryer, East Brunswick, N.J.; Raymond Frederick Watts, Long Valley, N.J.

[73] Assignee: Exxon Chemical Patents Inc., Linden, N.J.

[21] Appl. No.: 716,582

[22] Filed: Sep. 18, 1996

Related U.S. Application Data

[63] Continuation of Ser. No. 353,401, Dec. 9, 1994, abandoned.

[51] Int. Cl.[6] ..... C10M 137/00; C10M 137/14

[52] U.S. Cl. ..... 508/348; 508/349; 508/353

[58] Field of Search ..... 508/348, 349, 508/353

[56] References Cited

U.S. PATENT DOCUMENTS

| | | | |
|---|---|---|---|
| 2,750,342 | 6/1956 | Mikeska et al. | 252/46.6 |
| 4,031,023 | 6/1977 | Musser et al. | 252/48.2 |
| 4,105,571 | 8/1978 | Shaub et al. | 252/51.5 A |
| 4,428,849 | 1/1984 | Wisotsky | 252/33.4 |
| 4,511,480 | 4/1985 | Outlaw et al. | 252/8.55 E |
| 4,776,969 | 10/1988 | Ryer et al. | 252/46.7 |
| 4,857,214 | 8/1989 | Papay | 252/32.5 |
| 5,185,090 | 2/1993 | Ryer | 252/46.6 |
| 5,242,612 | 9/1993 | Ryer et al. | 252/46.7 |
| 5,443,744 | 8/1995 | Bloch et al. . | |

FOREIGN PATENT DOCUMENTS

| | | | |
|---|---|---|---|
| 0454110A1 | 10/1991 | European Pat. Off. | C10M 169/04 |
| 0622444A1 | 11/1994 | European Pat. Off. | C10M 125/24 |
| 2257158 | 1/1993 | United Kingdom | C10M 129/04 |

*Primary Examiner*—Margaret Medley

[57] ABSTRACT

This invention provides an oil-soluble complex of an oil-insoluble phosphorus-containing acid and an alcohol. This complex is a useful antiwear additive in lubricating oils, particularly automatic transmission fluids.

11 Claims, No Drawings

OIL SOLUBLE COMPLEXES OF PHOSPHORUS-CONTAINING ACIDS USEFUL AS LUBRICATING OIL ADDITIVES

This is a continuation of application Ser. No. 08/353,401, filed Dec. 9, 1994 now abandoned.

BACKGROUND OF THE INVENTION

1. Field of the Invention

This invention concerns oil soluble complexes of phosphorus-containing acids useful as additives in lubrication oils, particularly automatic transmission fluids.

2. Description of Related Art

It is well known that phosphorus-containing compounds are useful as antiwear additives in lubricating oils. Traditionally these materials are reaction products of phosphorus acids and oxides with long chain ($C_{10}$ to $C_{20}$) alcohols or amines to render them soluble in oleaginous media. Examples of this are shown in U.S. Pat. No. 5,185,090 where short chain ($C_2$ to $C_4$) phosphites are transesterified with longer chain alcohols (thioalcohols) and mixtures of alcohols (thioalcohols) to give oil soluble products. U.S. Pat. No. 5,443,744, discloses that $P_2O_5$ reacted with alcohols (thioalcohols) yield oil soluble products.

We have now found that insoluble or substantially insoluble phosphorus-containing acids can be solubilized without the need to react the phosphorus-containing acids with alcohols or amines. In particular, mineral acids of phosphorus such as phosphorous and phosphoric, can be solubilized by dissolving them at low temperatures in alcohols that contain either ether or thioether linkages. Once the hydroxy polyether and the acidic material are complexed, the acid remains completely soluble. These non-aqueous solutions of strong mineral acids allow their addition to lubricating oil additive concentrates or lubricating oils without violent exothermic reactions.

SUMMARY OF THE INVENTION

One embodiment of this invention relates to an oil-soluble additive, wherein the additive comprises the complex of a substantially oil-insoluble phosphorus-containing acid and an alcohol, the alcohol being a single alcohol or mixtures of alcohols represented by (I) or (II), where (I) and (II) are:

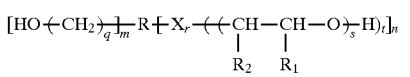

(I)

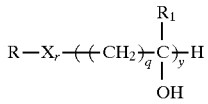

(II)

where:

m+n is an integer from 1 to 4;

m is O or an integer from 1 to 4;

n is O or an integer from 1 to 4;

q is O or an integer from 1 to 6;

R is a $C_1$–$C_{50}$ hydrocarbyl group in structure (I), and is a $C_1$–$C_{50}$ hydrocarbyl group or hydrogen in structure (II);

X is sulfur, oxygen, nitrogen, or —$CH_2$—;

r is O, or an integer from 1 to 5 providing when X is oxygen or nitrogen, r is 1, when X is sulfur, r is 1 to 3, when X is —$CH_2$—, r is 1 to 5;

s is O, or an integer from 1 to 12;

t is O, or an integer from 1 to 2 providing when X is sulfur, oxygen, or —$CH_2$—, t is 1, when X is nitrogen, t is 1 or 2;

y is O, or an integer from 1 to 10; and $R_1$ and $R_2$ are independently a $C_1$–$C_6$ alkyl or hydrogen.

In another embodiment, this invention concerns a lubricating oil composition comprising a lubrication oil basestock and an amount of the disclosed additive at least effective to impart antiwear properties to the basestock.

Accordingly, a further embodiment of this invention relates to a method of inhibiting wear in lubricating oil systems, including power transmission fluid systems, and particularly automatic transmission fluid systems.

Yet another embodiment of this invention relates to the method of forming the additive.

DETAILED DESCRIPTION OF THE INVENTION

Phosphorus-Containing Acids

Phosphorus-containing acids include those which are oil-insoluble or substantially oil-insoluble. The term substantially oil-insoluble is meant to include those acids whose limited solubility would be improved by following the teachings of this disclosure.

Generally, these phosphorus-containing acids are classified as acids containing a hydrogen dissociating moiety having a pKa from about −12 to about 5. The term pKa is defined as the negative base 10 logarithm of the equilibrium dissociation constant of the acid in an aqueous solution measured at 25° C.

Suitable phosphorus-containing acids are phosphoric acid ($H_3PO_4$), phosphorous acid ($H_3PO_3$), phosphinyl acids (including phosphinic acids and phosphinous acids), and phosphonyl acids (including phosphonic acids and phosphonous acids). Partial or total sulfur analogs of the foregoing phosphorus-containing acids are also suitable, including phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), and phosphorotetrathioic acid ($H_3PS_4$). Phosphorous acid and phosphoric acid are the most preferred acids.

Also contemplated as phosphorus-containing acids for purposes of this invention are phosphorus-containing acidic esters which are insoluble or substantially insoluble in oleaginous compositions. These compounds are encompassed by the following structure:

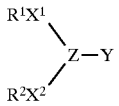

wherein Z is >P(X)— or >P—; Y is H or $X^3R^3$; $R^1$, $R^2$, and $R^3$ are each independently H or hydrocarbyl containing 1 to 6 carbon atoms, and $X^1$, $X^2$, $X^3$ and X are independently S or O, with the provisos that Y is H when Z is >P(X)—, and that when $X^1$ and $X^2$ are S, and Z is >P—, and Y is —$SR^3$. Types of compounds within the foregoing structure include phosphites, phosphates, thiophosphites, thiophosphates, thionophosphites, thionophosphates, and thiol-containing phosphites and phosphates.

Examples of the phosphorus-containing acidic esters which may be used in this invention include at least one compound of the formula:

(i) $R^1O(HO)P(=O)-Y$ monohydrocarbyl phosphite (Y = H)
monohydrocarbyl phosphate (Y = OH)
monohydrocarbyl thiolphosphate (Y = SH); or (ii) $R^1O(R^2O)P(=O)-Y$ dihydrocarbyl phosphite (Y = H)
dihydrocarbyl phosphate (Y = OH)
dihydrocarbyl thiolphosphate (Y = SH)

wherein $R^1$ and $R^2$ can be the same or different and are hydrocarbyl generally of from 1 to 6, preferably from 2 to 4, carbon atoms.

The hydrocarbyl thiono-containing compounds which may be used include:

(i) $R^1O(HO)P(=S)-Y$ monohydrocarbyl thionophosphite (Y = H)
monohydrocarbyl thionophosphate (Y = OH)
monohydrocarbyl dithionophosphate (Y = SH);

or (ii) $R^1O(R^2O)P(=S)-Y$ dihydrocarbyl thionophosphite (Y = H)
dihydrocarbyl thionophosphate (Y = OH)
dihydrocarbyl dithionophosphate (Y = SH)

wherein R1 and R2 are the same or different and are defined above.

The hydrocarbyl thiol-containing phosphite compounds which may be used include at least one compound of the formula:

(i) $R^1S(HO)P(=O)-Y$ monohydrocarbyl thiolphosphite (Y = H)
monohydrocarbyl thiolphosphate (Y = OH)
monohydrocarbyl dithiolphosphate (Y = SH);

or (ii) $R^1S(R^2S)P(=O)-Y$ dihydrocarbyl thiolphosphite (Y = H)
dihydrocarbyl thiolphosphate (Y = OH)
dihydrocarbyl dithiolphosphate (Y = SH)

As used in the specification and appended claims, the terms "hydrocarbyl" or "hydrocarbon-based" denote a group having a carbon atom directly attached to the remainder of the molecule and having predominantly hydrocarbon character within the context of this invention. Such groups include the following:

(1) Hydrocarbon groups; that is, aliphatic, (e.g., alkyl or alkenyl).

(2) Substituted hydrocarbon groups; that is, groups containing non-hydrocarbon substituents. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

The hydrocarbyl groups $R^1$ and $R^2$ may be the same or different hydrocarbyl groups, and generally, the total number of carbon atoms in $R^1$ and $R^2$ will be no greater than about 6. In a preferred embodiment the hydrocarbyl groups will contain from 2 to about 6 carbon atoms each, and preferably from about 2 to about 4 carbon atoms each. The hydrocarbyl groups $R^1$ and $R^2$ are aliphatic such as alkyl and alkenyl. Examples of $R^1$ and $R^2$ groups include methyl, ethyl, propyl, n-butyl, n-pentyl, and n-hexyl.

The $R^1$ and $R^2$ groups may each comprise a mixture of hydrocarbyl groups derived from commercially available $C_1$–$C_6$ alcohols.

The acidic esters are usually prepared by reacting $P_2O_5$ or $P_2S_5$ with the desired alcohol or thiol to obtain the substituted phosphorus-containing acids.

The hydroxy or thiol compound should contain hydrocarbyl groups of from about 2 to about 6 carbon atoms.

In the preparation of the hydrocarbyl-substituted thiophosphoric acids, any conventional method can be used, such as, the preparation described in U.S. Pat. Nos. 2,552,570; 2,579,038; and 2,689,220. For the preparation of hydrocarbyl-substituted thiophosphinic acids, such as conventionally known disubstituted thiophosphinic acids, see F. C. Witmore's Organic Chemistry", published by Dover Publications, New York, N.Y. (1961) page 848.

Preferred herein are hydrocarbyl phosphites and phosphates having the formula $D^1O(D^2O)P(=O)-D^3$ wherein $D^1$ is a hydrocarbyl group containing 1 to 6 carbon atoms, $D^2$ is a hydrocarbyl group containing 1 to 6 carbon atoms, and $D^3$ is H or OH. More preferred are hydrocarbyl phosphites and phosphates wherein $D^1$ and $D^2$ are hydrocarbyl groups containing from 1 to 3 carbon atoms, $D^3$ is H or OH. $D^1$ and $D^2$ may be an alkyl or alkenyl group, preferably an alkyl group such as methyl or ethyl. $D^3$ can be —$OD^2$ wherein $D^2$ is as defined above. Preferably the unsaturated members contain only double bonds. Examples of useful compounds are the dimethyl, diethyl, dibutyl, methylethyl, hexyl, phosphites and phosphates.

The phosphites and phosphates employed in this invention can be made using a single diol or mixtures of mono alcohols and diols . Such mixtures can contain from about 5% to about 95% by weight of any one constituent, the other constituent(s) being selected such that it or they together comprise from about 95% to about 5% by weight of the mixture. Mixtures are often preferred to the single-member component. The phosphite reaction can be performed at about 70° C. to about 250° C., with about 100° C. to about 160° C. being preferred. Less than a stoichiometric amount of phosphite can be used and is often preferred to a stoichiometric amount.

The more preferred phosphorus-containing acidic esters are the mono-, di- and hydrocarbon esters of phosphorous acid. Examples of these are: dimethyl phosphite, diethyl phosphite, dibutyl phosphite, and ethylmethyl phosphite. Most preferred are diethyl phosphites, dimethyl phosphites.

Alcohols:

The alcohols represented by structures (I) and (II) form a broad description of alcohols useful in this invention. It should be noted that the hydrocarbyl groups represented by R may be straight-chained, branched, or cyclic. Representative hydrocarbyl groups within this definition include alkyl, alkenyl, cycloalkyl, aralkyl, alkaryl, aryl, and their hetero-containing analogs.

Among the suitable alcohols within structure (I) are alkoxylated alcohols ($s \geqq 1$) and alkoxylated polyhydric alcohols ($s \geqq 1$ and $m+n+t \geqq 2$), and mixtures thereof.

Examples of particularly useful alkoxylated alcohols are nonyl phenol pentaethoxylate, pentapropoxylated butanol, hydroxyethyloctyl sulfide, and diethoxylated dodecyl mercaptan.

Examples of particularly useful alkoxylated polyhydric alcohols are oleyl amine tetraethoxylate, 5-hydroxy-3-thio butanol triethoxylate, thiobisethanol, diethoxylated tallow amine, dithiodiglycol, tetrapropoxylated cocoamine, diethylene glycol, and 1,7-dihydroxy-3,5-dithioheptane.

Among the suitable alcohols within structure (II) are the polyhydric alcohols ($y \geqq 2$). Examples of particularly useful polyhydric alcohols are pentaerythritol, 1-phenyl-2, 3propane diol, polyvinyl alcohol, 1,2-dihydroxy hexadecane and 1,3-dihydroxy octadecane.

A particularly useful combination of alcohols are those represented by (III), (IV), and mixtures thereof, where (III) and (IV) are:

$$A—OH \quad (III)$$

and $$OH—B—OH \quad (IV)$$

where

A is $$\begin{array}{l} Y_1 \\ | \\ CH—(OCH_2CH_2)n_1— \text{ or } Y_1—\underset{\underset{X_1}{|}}{CH}—(OCH_2\underset{\underset{CH_3}{|}}{CH}—)n_1—; \\ | \\ X_1 \end{array}$$

$X_1$ is H or $R_2SCH_2$—;

$Y_1$ is $$R_2SCH_2—,\ R_2S\underset{\underset{CH_3}{|}}{CH}CH_2—,\ R_2S\underset{\underset{\underset{CH_3}{|}}{CH_2}}{\underset{|}{CH}}CH_2—,$$

$$R_2S\underset{\underset{CH_3}{|}}{CH}—,\ R_2SCH_2\underset{\underset{CH_3}{|}}{CH}—,\ \text{or } R_2SCH_2\underset{\underset{\underset{CH_3}{|}}{CH_2}}{\underset{|}{CH}}—;$$

$n_1$ is an integer from 0–12;

B is $—CH_2CH_2SCH_2CH_2—$, $—CH_2CH_2SSCH_2CH_2—$ or $$R_3\underset{|}{C}HCH_2SR_4—;$$

and $R_2$ and $R_3$ are the same or different and are H or a hydrocarbyl group containing up to 50 carbon atoms. $R_4$ is a hydrocarbyl group containing up to 50 carbon atoms.

The $R_2$, $R_3$, and $R_4$ groups of the alcohols (III) and (IV) are hydrocarbyl groups which may be straight-chained, branched, or cyclic. Representative hydrocarbyl groups include alkyl, alkenyl, cycloalkyl, aralkyl, alkaryl, and their hetero-containing analogs.

The hetero-containing hydrocarbyl groups may contain one or more hetero atoms. A variety of hetero atoms can be used and are readily apparent to those skilled in the art. Suitable hetero atoms include, but are not limited to, nitrogen, oxygen, phosphorus, and sulfur.

When the hydrocarbyl group is alkyl, straight-chained alkyl groups are preferred—typically those that are about $C_2$ to $C_{18}$, preferably about $C_4$ to $C_{12}$, most preferably about $C_6$ to $C_{10}$ alkyl. When the hydrocarbyl group is alkenyl, straight-chained alkenyl groups are preferred—typically those that are about $C_3$ to $C_{18}$, preferably about $C_4$ to $C_{12}$, most preferably about $C_6$ to $C_{10}$ alkenyl. When the hydrocarbyl group is cycloalkyl, the group typically has about 5 to 18 carbon atoms, preferably about 5 to 16, most preferably about 5 to 12. When the hydrocarbyl group is aralkyl and alkaryl, the aryl portion typically contains about $C_6$ to $C_{12}$, preferably 6 carbon atoms, and the alkyl portion typically contains about 0 to 18 carbon atoms, preferably 1 to 10.

Straight-chained hydrocarbyl groups are preferred over branched or cyclic groups. However, if the hydrocarbyl group constitutes the less preferred cycloalkyl group, it may be substituted with a $C_1$ to $C_{18}$ straight-chained alkyl group, preferably $C_2$ to $C_8$.

Representative examples of suitable hydrocarbyl groups for alcohols (III) and (IV) include methyl, ethyl, propyl, butyl, pentyl, hexyl, heptyl, octyl, 2-ethylhexyl, isooctyl, tertiary-octyl, nonyl, isononyl, tertiary-nonyl, secondary-nonyl, decyl, isodecyl, undecyl, dodecyl, tridecyl, palmityl, stearyl, isostearyl, octenyl, nonenyl, decenyl, dodecenyl, oleyl, linoleyl and linolenyl, cyclooctyl, benzyl, octylphenyl, dodecylphenyl, and phenyloctyl.

The preferred hydrocarbyl groups for alcohol (III) are hexyl, octyl, decyl, and dodecyl. The preferred hydrocarbyl groups for alcohol (IV) are, for $R_3$: methyl, ethyl, and propyl; and, for $R_4$: methylene, ethylene, propylene, and isopropylene.

Alcohols (III) and (IV) may be prepared by conventional methods widely known in the art. For example, a thioalcohol is produced by oxyalkylation of a mercaptan containing the desired hydrocarbyl group. Suitable oxyalkylating agents include alkylene oxides such as ethylene oxide, propylene oxide, butylene oxide, and mixtures thereof. The most preferred alkylene oxide is ethylene oxide. Thus, the preferred thioalcohol may be prepared by the following reaction equation:

$$RSH+\text{Ethylene Oxide} \rightarrow RSCH_2CH_2OH \quad (V)$$

where R is defined above.

To produce the desired alcohol, a more preferred reaction route is:

$$RCH{=}CH_2+HSR_2OH \rightarrow RCH_2CH_2SR_2OH \quad (VI)$$

wherein R and $R_2$ are described above. Reaction equation (VI) is preferred because it yields a higher percentage of the desired alcohol whereas reaction equation (V) may produce a single alcohol of the formula $RS(CH_2CH_2O—)_n—H$, where $n>1$, or a mixture of alcohols where $n>1$ and varies.

Complex Formation:

An example of this invention is illustrated below:

$$(a)\ A—OH+(b)\ OH—B—OH+H_3PO_4 \rightarrow \text{Complex} \quad (VII)$$

where A and B are defined above, and $1 \leqq a+2b \leqq 6$.

A preferred complex of this invention is formed by a monoalcohol and may be represented by the following equation:

$$(a)\ RSCH_2CH_2OH+H_3PO_4 \rightarrow \text{Complex} \quad (VIII)$$

where R is defined above.

Typically, the complexing of mineral acid and alcohol is carried out under atmospheric pressure and at temperatures ranging from about −10° to 65°, preferably 25° to 55°, more preferably 25° to 50°, most preferably 35° to 45° C. At these temperatures, a complex is formed without producing water. At temperatures greater than 65° C., water will likely be produced which evidences that an etherification reaction has occurred. However, preparation at temperatures below 65° C. make it less likely that an etherification reaction will occur which may result in oil insoluble ether compounds. Complexing times range from about 0.5 to about 4 hours. Sufficient complexing can typically be achieved in about two hours.

One method of forming the complex is first to dissolve the appropriate amount of the phosphorus-containing acid in water. The acid may be purchased as an aqueous concentrate, i.e., 70% in water, thereby eliminating the dissolution step. The alcohols (or thioalcohols) are then added to the aqueous solution of acid and the temperature raised to the desired level with stirring until a homogeneous mixture is produced.

After the phosphorus-containing acids and alcohols have sufficient time to complex, it may be desirable to remove water, i.e., water that may have been used to dissolve the acid. The water may be removed at atmospheric pressure or the complex may be placed under vacuum. Stripping times and temperatures vary according to the desired degree of stripping. The vacuum can range from about −65 to about −90 kPa, stripping times from about 1 to about 2 hours, and temperatures from 50° to 65° C. Typically, sufficient water removal may be achieved at a vacuum of about −60 kPa which is maintained for about 1 hour at 55° C.

A second method of forming a stable complex is to dissolve the anhydrous acid in the alcohol mixture. It is sometimes desirable to then add a small amount of water to the blend. Typically, 1–5 weight percent of water will give a stable homogeneous material.

The complexes shown in equations (VII) and (VIII) may be added to a lubricating oil basestock in an amount sufficient to impart antiwear properties. The typical range is 0.05 to 1.0 weight percent of 100% active ingredient, preferably 0.4 to 0.8 weight percent, most preferably 0.5 to 0.7 weight percent. The preferred range corresponds to approximately 0.02 to 0.04 mass percent phosphorus in the oil.

Desirably, a source of boron is present with the complex of this invention in the lubrication oil basestock. The presence of boron tends to lessen the deterioration of silicone-based seals. The boron source may be present in the form of borated dispersants, borated amines, borated alcohols, borated esters, or alkyl borates.

Accordingly, by adding an effective amount of this invention's complex to a lubricating oil and then placing the resulting lubrication oil within a lubrication system, the oil will inhibit wear in metal-to-metal contact in the lubrication fluid.

The lubrication oil basestock may contain one or more additives to form a fully formulated lubricating oil. Such lubricating oil additives include corrosion inhibitors, detergents, pour point depressants, antioxidants, extreme pressure additives, viscosity improvers, friction modifiers, and the like. These additives are typically disclosed in, for example, "Lubricant Additives" by C. V. Smalheer and R. Kennedy Smith, 1967, pp. 1–11 and in U.S. Pat. No. 4,105,571, the disclosures of which are incorporated herein by reference. A fully formulated lubricating oil normally contains from about 1 to about 20 weight % of these additives. Borated or unborated dispersants may also be included as additives in the oil, if desired. However, the precise additives used (and their relative amounts) will depend upon the particular application of the oil. Contemplated applications for formulations of this invention include gear oils, industrial oils, lubricating oils, and power transmission fluids, especially automatic transmission fluids. The following list shows representative amounts of additives in lubrication oil formulations:

| Additive | (Broad) Wt. % | (Preferred) Wt. % |
|---|---|---|
| VI Improvers | 1–12 | 1–4 |
| Corrosion Inhibitor/Passivators | 0.01–3 | 0.01–1.5 |
| Anti-Oxidants | 0.01–5 | 0.01–1.5 |
| Dispersants | 0.10–10 | 0.1–8 |
| Anti-Foaming Agents | 0.001–5 | 0.001–1.5 |
| Detergents | 0.01–6 | 0.01–3 |
| Anti-Wear Agents | 0.001–5 | 0.001–1.5 |
| Pour Point Depressants | 0.0–12 | 0.01–1.5 |
| Seal Swellants | 0.1–8 | 0.1–6 |
| Friction Modifiers | 0.0–13 | 0.01–1.5 |
| Lubricating Base Oil | Balance | Balance |

Particularly suitable detergent additives for use with this invention include ash-producing basic salts of Group I (alkali) or Group II (alkaline) earth metals and transition metals with sulfonic acids, carboxylic acids, or organic phosphorus acids.

Particularly suitable types of antioxidant for use in conjunction with the complex of this invention are the amine-containing and hydroxy aromatic-containing antioxidants. Preferred types of these antioxidants are alkylated diphenyl amines and substituted 2,6 di-t-butyl phenols.

The additive complex of this invention may also be blended to form a concentrate. A concentrate will generally contain a major portion of the complex together with other desired additives and a minor amount of lubrication oil or other solvent. The complex and desired additives (i.e., active ingredients) are provided in the concentrate in specific amounts to give a desired concentration in a finished formulation when combined with a predetermined amount of lubrication oil. The collective amounts of active ingredient in the concentrate typically are from about 0.2 to 50, preferably from about 0.5 to 20, most preferably from 2 to 20 weight % of the concentrate, with the remainder being a lubrication oil basestock or a solvent.

The complex of this invention may interact with the amines contained in the formulation (i.e., dispersant, friction modifier, and antioxidant) to form quaternary ammonium salts. The formation of amine and quaternary ammonium salts, however, will not adversely affect antiwear characteristics of this invention.

Suitable lubrication oil basestocks can be derived from natural lubricating oils, synthetic lubricating oils, or mixtures thereof. In general, the lubricating oil basestock will have a viscosity in the range of about 5 to about 10,000 $mm^2/s$ (cSt) at 40° C., although typical applications will require an oil having a viscosity ranging from about 10 to about 1,000 $mm^2/s$ (cSt) at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers, and their derivatives where the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicone-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hex-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydroforans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

This invention may be further understood by reference to the following examples which are not intended to restrict the scope of the appended claims.

EXAMPLES

Example 1

Into a five liter round-bottomed flask equipped with a stirrer, thermometer, nitrogen gas inlet and condenser with Deane-Stark trap were charged 246 gms (3.0 moles) of solid phosphorous acid and 52 gms of water. The mixture was stirred to dissolve the phosphorous acid. When the phosphorous acid had dissolved, 570.8 gms (3.0 moles) of octylthioethanol and 463 gms (3.0 moles) dithiodiglycol were charged to the flask. The mixture was stirred and heated to 50° C. for 2 hours. The temperature was then raised to 60°–65° C. and the water distilled off at a vacuum of 40 mm. When the water evolution stopped, the product was cooled. The product was a light yellow liquid which was calculated to have 7.2% P and 22.3% S.

Example 2

The procedure of Example 1 was repeated with the materials charged to the flask being: 570 gms (3 moles) of octylthioethanol, 246 gms (3 moles) of $H_3PO_3$ and 367 gms (3 moles) of thiobisethanol. The product was a light yellow liquid which was calculated to have 7.9% P and 16.2% S.

Example 3

In a one liter flask equipped with a stirrer, Deane-Stark trap, thermometer and dry ice trap was placed 190 grams (1 mole) of octylthioethanol, 154 gms (1 mole) dithiodiglycol and 115 gms (1 mole) of 85% phosphoric acid. Stirring was started, at which time an exotherm of 10° C. was observed. The mixture was slowly heated to 50° C., at which time another exotherm of 15° C. occurred. The temperature was maintained at 50° C. for two hours. The pressure was then reduced to −85 kPa and the temperature raised to 65° C. The stirring was continued under these conditions for one hour, during which time approximately 2 $cm^3$ of water were collected in the Deane-Stark trap. The mixture was cooled and filtered. It yielded a light yellow product which was calculated to have 6.8% P and 21.1% S.

Example 4

The procedure of Example 3 was repeated with the materials charged to the reactor being: 570 gms (3 moles) of octylthioethanol, 115 gms (1 mole) of 85% phosphoric acid. The product was a light yellow solution calculated to have 4.5% P and 14% S.

Example 5

To a one liter flask equipped with a stirrer, thermometer and nitrogen sweep were charged 290 gms (1 mole) of diethoxylated dodecyl mercaptan and 39.9 gms (0.35 mole) of 85% phosphoric acid. Upon mixing a slight exotherm was observed. The mixture was stirred at 25°–30° C. for one hour. The resultant water white (i.e., clear and colorless) product was calculated to have 3.3% P and 9.7% S.

Example 6

The above procedure was repeated using 40.3 gms (0.35 mole) of 70% phosphorous acid in place of the phosphoric acid. The resulting light yellow liquid was calculated to have 3.3% P and 9.7% S.

Example 7

To a one liter flask equipped with a stirrer, thermometer and nitrogen sweep were charged 300 gms (approx. 0.7 mole) of a pentaethoxylated isooctyl phenol (Commercially known as Plexol 305®) and 30.1 gms (0.26 mole) of 85% phosphoric acid. The mixture was stirred at 25°–30° C. for one hour. The light yellow product was calculated to have 2.4% P.

Example 8

The procedure of Example 7 was repeated except that 30.6 gms (0.26 mole) of 70% phosphorous acid was used in place of the phosphoric acid. The light yellow product was calculated to have 2.4% P.

Example 9

To a 500 ml flask equipped with a stirrer, thermometer and nitrogen sweep were charged 150 gms (1.4 moles) of diethylene glycol and 108.5 gms (0.95 mole) of 85% phosphoric acid. The mixture was stirred at 25°–30° C. for one hour. The light yellow product was calculated to have 11.3% P.

Example 10

The procedure of Example 9 was repeated except that 110 gms (0.95 mole) of 70% phosphorous acid was substituted for the phosphoric acid. The product was calculated to have 11.3% P.

Example 11

To a one liter flask equipped with a stirrer, thermometer and nitrogen sweep were charged 300 gms (approx. 0.8 mole) of a pentapropoxylated butanol (commercially known as LB 135®) and 18.0 gms (0.16 mole) of 85% phosphoric acid. The mixture was stirred at 25°–30° C. for one hour. The product was calculated to have 1.6% P.

Example 12

The procedure of Example 11 was repeated except that 18.3 gms (0.16 mol) of phosphorous acid was substituted for the phosphoric acid. The product was calculated to have 1.6% P.

Example 13

To a 500 ml flask equipped with a stirrer, thermometer and nitrogen sweep were charged 152 gms (1.0 mole) of 1-phenyl-2,3-propanediol and 75.6 gms (0.66 mole) of 85% phosphoric acid. The mixture was stirred at 25°–30° C. for one hour. The water white product was calculated to have 9.0% P.

Example 14

The procedure of Example 13 was repeated except that 77 gms (0.66 mole) of 70% phosphorous acid was used in place of the phosphoric acid. The product was calculated to have 9.0% P.

The product stability of the samples of Examples 1 to 14 were assessed by observing the samples stored at room temperature and 0° C. for 90 days. All samples remained clear with no separation evident.

What is claimed is:

1. An oil-soluble additive wherein the additive comprises the complex of a substantially oil-insoluble phosphorus-containing acid and an alcohol formed at temperature from about −10° to 50° C., the alcohol being a single alcohol or mixtures of alcohols represented by (I) or (II), where (I) and (II) are:

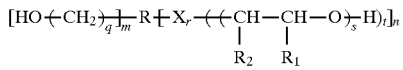

(I)

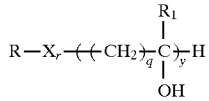

(II)

where:

m+n is an integer from 1 to 4;

m is 0 or an integer from 1 to 4;

n is 0 or an integer from 1 to 4;

q is 0 or an integer from 1 to 6;

R is a $C_1$–$C_{50}$ hydrocarbyl group in structure (I) and is a $C_1$–$C_{50}$ hydrocarbyl group or hydrogen in structure (II);

X is sulfur, oxygen, nitrogen, or —$CH_2$—;

r is 0, or an integer from 1 to 5 providing when X is oxygen or nitrogen, r is 1, when X is sulfur, r is 1 to 3, when X is —$CH_2$—, r is 1 to 5;

s is 0, or an integer from 1 to 12;

t is 0, or an integer from 1 to 2 providing when X is sulfur, oxygen, or —$CH_2$—, t is 1, when X is nitrogen, t is 1 or 2;

y is 0, or an integer from 1 to 10; and $R_1$ and $R_2$ are independently a $C_1$–$C_6$ alkyl or hydrogen.

2. The additive of claim 1, wherein the acid has a pKa from about −12 to about 5 in aqueous solutions measured at 25° C.

3. The additive of claim 2, wherein the acid is phosphorous acid, phosphoric acid, dimethyl phosphite, diethyl phosphite, or mixtures thereof.

4. The additive of claim 3, wherein the alcohol selected from the group consisting of a single alcohol or mixtures of alcohols presented by (III) and (IV), where (III) and (IV) are:

(III)

and (IV)

where:

A is

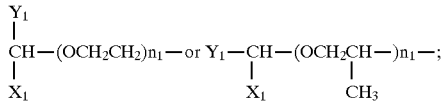

$X_1$ is H;

$Y_1$ is

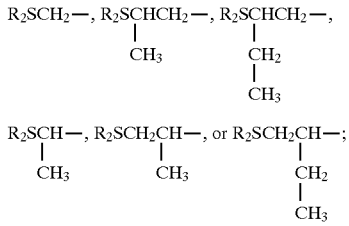

$n_1$ is an integer from 0–12;

B is $—CH_2CH_2SCH_2CH_2—$, $—CH_2CH_2SSCH_2CH_2—$ or

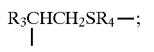

where $R_2$ and $R_3$ are the same or different and are H or a hydrocarbyl group containing up to 50 carbon atoms; and $R_4$ is a hydrocarbyl group containing up to 50 carbon atoms.

5. The additive of claim 4 where (III) and (IV) are mixed with the acid in the molar ratio of alcohol to acid of 1:1 to 6:1, and the amount of (III) is at least twice the amount of (IV).

6. The additive of claim 5, where $R_2$, $R_3$, and $R_4$ represent alkyl, alkenyl, cycloalkyl, aralkyl, or alkaryl.

7. The additive of claim 6, where A is $R_2SCH_2CH_2—$, $R_2$ is a $C_1$–$C_{15}$ alkyl.

8. A lubricating oil composition comprising a major amount of lubricating oil basestock and an antiwear effective amount of the additive of claim 1.

9. A concentrate composition comprising the additive of claim 1 and a minor amount of lubrication oil or solvent.

10. An oil-soluble additive wherein the additive comprises the complex of a substantially oil-insoluble phosphorus-containing acid and an alcohol formed at a temperature from about −10° to 50° C., the alcohol being a single alcohol or mixture of alcohols represented by (III) and (IV), where (III) and (IV) are:

$$A—OH \quad (III)$$

and $$OH—B—OH \quad (IV)$$

where:

A is

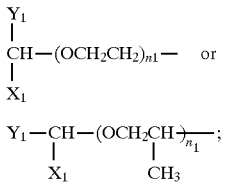

$X_1$ is $R_2SCH_2—$;

$Y_1$ is

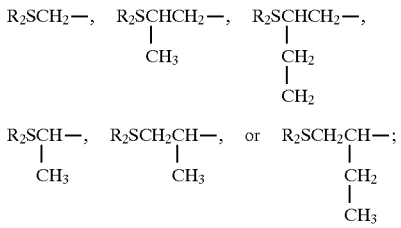

$n_1$ is an integer from 0–12;

B is $—CH_2CH_2SCH_2CH_2—$, $—CH_2CH_2SSCH_2CH_2—$ or

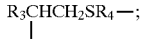

where $R_2$ and $R_3$ are the same or different and are H or a hydrocarbyl group containing up to 50 carbon atoms; and $R_4$ is a hydrocarbyl group containing up to 50 carbon atoms.

11. The oil-soluble additive according to claim 1, wherein the complex is formed at a temperature from about 35° C. to 45° C.

* * * * *

UNITED STATES PATENT AND TRADEMARK OFFICE

CERTIFICATE OF CORRECTION

PATENT NO. : 5,773,392

DATED : June 30, 1998

INVENTOR(S) : M.G. Romanelli, R.A. Bloch, J. Ryer, R.F. Watts

It is certified that error appears in the above-identified patent and that said Letters Patent is hereby corrected as shown below:

In column 14, claim 10, delete the formula

" 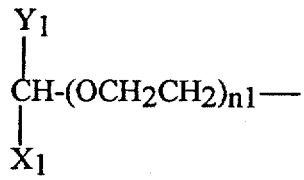 "

and insert therefor

-- 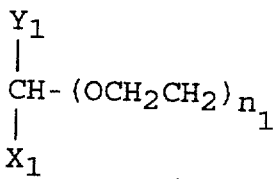 -- ,

UNITED STATES PATENT AND TRADEMARK OFFICE

CERTIFICATE OF CORRECTION

PATENT NO. : 5,773,392

DATED : June 30, 1998

INVENTOR(S) : M.G. Romanelli, R.A. Bloch, J. Ryer, R.F. Watts

It is certified that error appears in the above-identified patent and that said Letters Patent is hereby corrected as shown below:

delete "$X_1$ is $R_2SCH_2$—;" and insert therefor -- $X_1$ is H or $R_2SCH_2$—; -- , delete the formula " 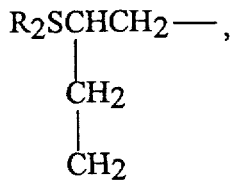 ,  "

and insert therefor

-- 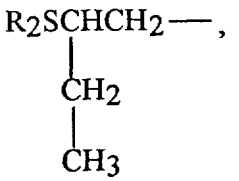 ,  --

Signed and Sealed this

Twenty-ninth Day of December, 1998

*Attest:*

BRUCE LEHMAN

*Attesting Officer*

*Commissioner of Patents and Trademarks*